US009325132B2

(12) United States Patent
Hsu

(10) Patent No.: US 9,325,132 B2
(45) Date of Patent: Apr. 26, 2016

(54) POWER EXTENSION CORD WITH MOVABLE OUTLET MODULES

(71) Applicant: POWERTECH INDUSTRIAL CO., LTD., New Taipei (TW)

(72) Inventor: Jung-Hui Hsu, New Taipei (TW)

(73) Assignee: POWERTECH INDUSTRIAL CO., LTD., New Taipei (TW)

( * ) Notice: Subject to any disclaimer, the term of this patent is extended or adjusted under 35 U.S.C. 154(b) by 20 days.

(21) Appl. No.: 13/680,208

(22) Filed: Nov. 19, 2012

(65) Prior Publication Data

US 2014/0004718 A1 Jan. 2, 2014

(30) Foreign Application Priority Data

Jul. 2, 2012 (TW) ..... 101123683 A

(51) Int. Cl.

| | |
|---|---|
| ***H01R 25/00*** | (2006.01) |
| ***H01R 31/06*** | (2006.01) |
| ***H01R 35/04*** | (2006.01) |
| *H01R 13/72* | (2006.01) |

(52) U.S. Cl.

CPC ..... *H01R 31/06* (2013.01); *H01R 25/003* (2013.01); *H01R 35/04* (2013.01); *H01R 13/72* (2013.01)

(58) Field of Classification Search

CPC .... H01R 31/02; H01R 25/006; H01R 25/003; H01R 31/06; H01R 13/70

USPC ..... 439/650–653

See application file for complete search history.

(56) References Cited

U.S. PATENT DOCUMENTS

| | | | | |
|---|---|---|---|---|
| 5,052,937 | A * | 10/1991 | Glen | 439/120 |
| 5,688,132 | A | 11/1997 | Rogers | |
| 5,759,051 | A | 6/1998 | Cancellieri | |
| 5,788,521 | A * | 8/1998 | Milan | 439/214 |
| 7,347,734 | B1 * | 3/2008 | Teitelbaum | 439/652 |
| 7,497,740 | B2 * | 3/2009 | Mei et al. | 439/652 |
| 7,544,100 | B2 * | 6/2009 | Teitelbaum | 439/652 |
| 7,556,511 | B1 * | 7/2009 | Hsu et al. | 439/119 |
| 7,771,239 | B1 * | 8/2010 | Hsiao | 439/640 |
| 7,874,856 | B1 * | 1/2011 | Schriefer et al. | 439/214 |
| 7,881,034 | B2 * | 2/2011 | Lee et al. | 361/118 |

(Continued)

FOREIGN PATENT DOCUMENTS

| | | | |
|---|---|---|---|
| CN | 1436383 | A | 8/2003 |
| JP | 2001-23740 | A | 1/2001 |

(Continued)

*Primary Examiner* — Briggitte R Hammond

(74) *Attorney, Agent, or Firm* — Li & Cai Intellectual Property (USA) Office

(57) ABSTRACT

The present disclosure provides a power extension cord with movable outlet modules, which includes a power input portion, a casing, and a plurality of outlet modules. The power input portion is connected to a city power source. The casing at least includes a first accommodating portion having at least a first sliding track. Each of the outlet modules is electrically connected to the power input portion, and at least one outlet module is movably disposed on the first sliding track. When all the outlet modules are arranged on the first accommodating portion, at least one outlet module becomes immovable on the first sliding track. When one or more outlet modules are dislocated from the first accommodating portion, at least one of the outlet modules becomes movable along the first sliding track. Accordingly, the present disclosure may thus effectively utilize the pin holes associated with each outlet module.

8 Claims, 9 Drawing Sheets

(56) References Cited

U.S. PATENT DOCUMENTS

| | | | | |
|---|---|---|---|---|
| 7,934,932 | B1 * | 5/2011 | Lee et al. | 439/31 |
| 8,033,867 | B1 * | 10/2011 | Kessler et al. | 439/652 |
| 8,157,574 | B2 * | 4/2012 | Hsiao | 439/131 |
| 8,226,444 | B2 * | 7/2012 | Chow | 439/651 |
| 8,264,099 | B2 * | 9/2012 | Aldag et al. | 307/12 |
| 8,585,444 | B2 * | 11/2013 | Chang | 439/651 |
| 8,616,921 | B2 * | 12/2013 | Byrne et al. | 439/652 |
| 2008/0009157 | A1 * | 1/2008 | Hsu | 439/116 |

FOREIGN PATENT DOCUMENTS

| | | |
|---|---|---|
| JP | 2010-34013 A | 2/2010 |
| TW | 483615 | 4/2002 |
| TW | M323745 | 12/2007 |

* cited by examiner

POWER EXTENSION CORD WITH MOVABLE OUTLET MODULES

BACKGROUND

1. Technical Field

The present disclosure relates to a power extension cord, in particular, to a power extension cord with movable outlet modules.

2. Description of Related Art

Electronic product generally are equipped with a corresponding power adapter for converting the AC voltage from the city power source to a DC voltage qualifying specific operating requirement to have the electronic product operating normally. However, the power adapters adopted by different electronic product not only do not have unified output standard, the associated volume and shaped may also vary. Hence, in practice when a user plugs a power adapter into an receptacle of the power extension cord, the power adapter having larger size may cover the nearby receptacle, causing the nearby receptacle unable to accept other power plugs or plug of power adapter.

Recently, industries have offering a retractable power extension cord in overcoming the aforementioned issue. However, the provided power extension cord mainly increases the distance between the numerous receptacles disposed on the casing through pulling and retracting the cord to prevent the nearby receptacles been completely covered by the power adapter having larger size. Moreover, rotatable power extensions (e.g., power extension with rotatable receptacles) have been further provided so that the power adapter plugging position may be flexibly configured through rotating the receptacles.

Nevertheless, conventional retractable power extension cords not only have disadvantages including complex mechanical structure and in the form of larger size, but also having issues of higher manufacturing cost and poor durability. In addition, as conventional power extension cords are incapable of increasing the gap between adjacent receptacles and the issue of having a receptacle being occupied by a relative large power adapter cannot be effectively addressed by rotating the receptacle at any angle. Henceforth, there is a need in the industry for power extension cord having simplify structure while can effectively resolving the issue of having the nearby receptacle being covered by the power adapter thereby enabling user utilizing all receptacles on the power extension cord.

SUMMARY

Accordingly, an exemplary embodiment provide a power extension cord having rotatable retractable module which enables a user sliding the outlet modules thereof when necessary without the need of pulling or retracting cords in and out of the casing.

An exemplary embodiment of the present disclosure provides a power extension cord with movable outlets. The power extension cord with movable outlets includes a power input portion, a casing, and a plurality of outlet modules. The power input portion is detachably connected to a city power source. The casing at least having a first accommodating portion which includes at least a first sliding track. Each outlet module is electrically connected to the power input portion and is movably disposed on the first sliding track. When all outlet modules are arranged on the first accommodating portion, the pin hole associated with each outlet module are exposed on a first surface of the casing with at least an outlet module is immovably arranged on the first sliding track. When at least an outlet module is dislocated from the first accommodating portion, at least an outlet module arranged on the first sliding track becomes movable.

To sum up, an exemplary embodiment provides a power extension cord which can through dislocate at least an outlet module out of a first accommodating portion enabling the remaining outlet modules to freely move along the first sliding track. The movable space of the remaining outlet modules is equal to the space occupied by the outlet modules being removed. Since the power extension cord provided by the present disclosure only has the outlet modules sliding within the casing thereof and does not need either the pulling structure or any modifications to the casing structure. Henceforth, the power extension cord provided by the present disclosure can not only greatly increase the durability but also can resolve the issue of having the nearby outlet being covered by power adapter with larger size using simple structure thereby lowered the manufacture cost.

In order to further understand the techniques, means and effects of the present disclosure, the following detailed descriptions and appended drawings are hereby referred, such that, through which, the purposes, features and aspects of the present disclosure can be thoroughly and concretely appreciated; however, the appended drawings are merely provided for reference and illustration, without any intention to be used for limiting the present disclosure.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

DESCRIPTION OF THE EXEMPLARY EMBODIMENTS

Figure 1A:
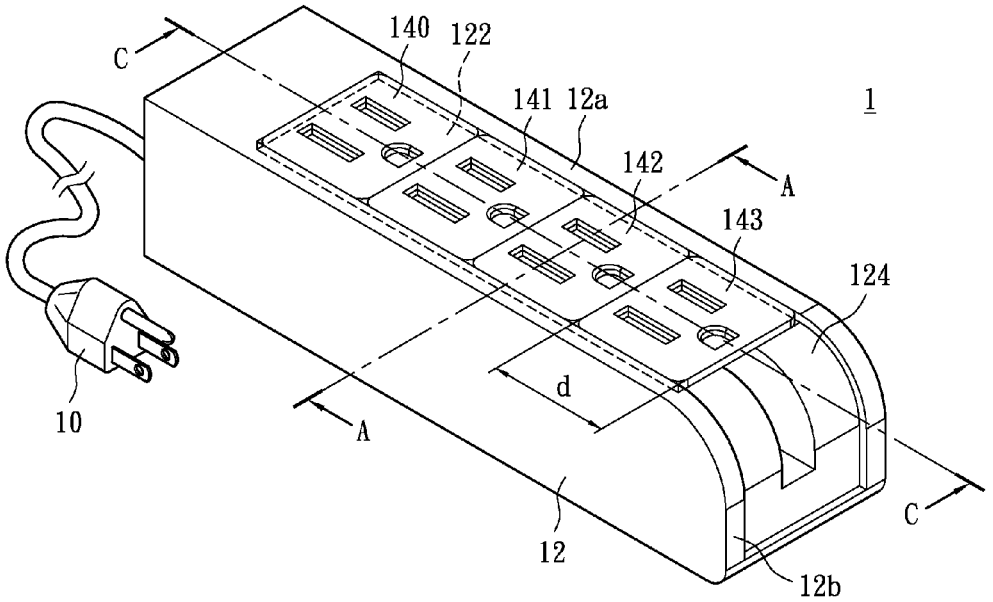
FIG. 1A is an isometric diagram illustrating a power extension cord provided in accordance to an exemplary embodiment of the present disclosure.

Reference will now be made in detail to the exemplary embodiments of the present disclosure, examples of which are illustrated in the accompanying drawings. Wherever possible, the same reference numbers are used in the drawings and the description to refer to the same or like parts.

(An Exemplary Embodiment of a Power Extension Cord)

Figure 1B:
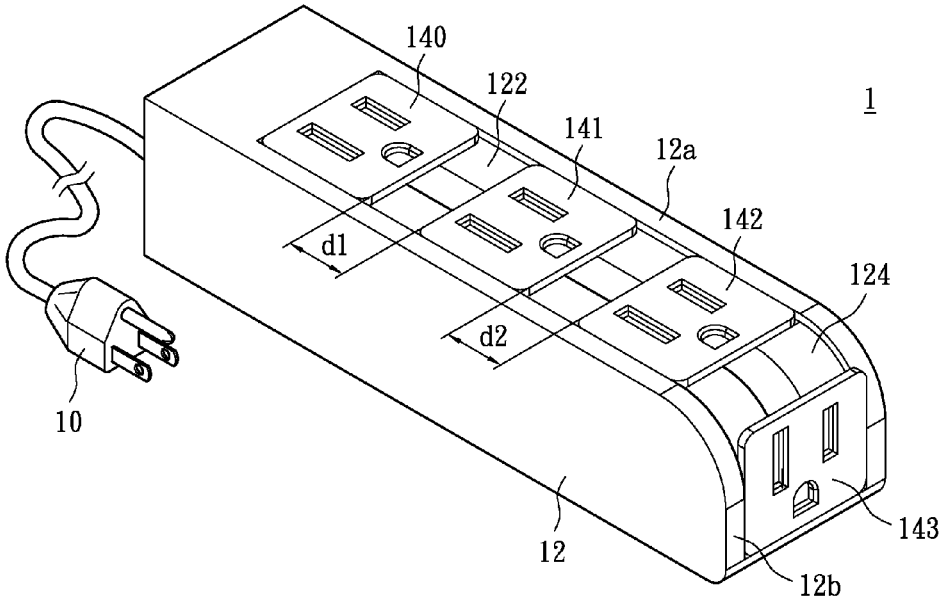
FIG. 1B is an isometric diagram illustrating the power extension cord in operation provided in accordance to an exemplary embodiment of the present disclosure.

Please refer to FIG. 1A and FIG. 1B. FIG. 1A shows an isometric diagram illustrating a power extension cord provided in accordance to an exemplary embodiment of the present disclosure. FIG. 1B is an isometric diagram illustrating the power extension cord in operation provided in accordance to the exemplary embodiment of the present disclosure. The power extension cord 1 of the instant embodiment includes a power input portion 10, casing 12, and a plurality of outlet modules 140~143. The outlet modules 140~143 are tightly and sequentially arranged on an upper surface 12*a* of the casing 12. Detail descriptions for each component of power extension cord 1 are provided in the following paragraphs.

The power input portion 10 can electrically connect to an external city power source for transferring the city power to a plurality of conductive contacts (not shown in FIG. 1A and FIG. 1B) arranged in the casing 10. So that the outlet modules 140~143 may be energized through the power input portion 10 and the plurality of conductive contacts. In practice, the power input portion 10 may include a plug, in which the plug can be detachably connected to a receptacle (e.g., wall outlet) so that the city power can energize the outlet modules 140~143 through a flexible wire or a non-flexible conductor, and a conductive plate. The power input portion 10 may further include a switching component, a rectifying component, a transformer component, a surge protection component or other appropriate electrical components. Those skilled in the art shall be able to design or implement the power input portion 10 according to the actual needs and the present disclosure is not limited thereto.

The casing 12 is the main body of the power extension cord 1, wherein the casing 12 has an accommodating portion 122 and an accommodating portion 124. The casing 12 further has at least a sliding track (not shown in FIG. 1A and FIG. 1B) and a plurality of conductive contacts disposed therein. An opening of the accommodating portion 122 is disposed on the upper surface 12*a* of the casing 10 while an opening of the accommodating portion 124 at least includes a side surface 12*b* of the casing 12. In the embodiment illustrated by FIG. 1A and FIG. 1B, the accommodating portions 122 and 124 are the recessed regions located on the outer surface of the casing 12. Even though the openings of the accommodating portions 122 and 124 are located at different planes but the space of the accommodating portions 122 and 124 are interconnected. It shall be notes that although FIG. 1A and FIG. 1B shows that the opening of the accommodating portion 124 only extends to the side surface 12*b*, however in practice the opening of the accommodating portion 124 may further extend to the bottom surface (i.e. the opposite surface with respective to the upper surface 12*a*) or other surface, and the present disclosure is not limited thereto.

The outlet modules 140~143 are disposed on the sliding track (not shown in FIG. 1A and FIG. 1B) with each of the outlet modules 140~143 has at least a pin hole. When the conductive blade of the plug of an external electrical equipment is plugged or engaged in a pin hole of any outlet modules 140~143, the conductive blade of the plug may electrically connect to the plurality of conductive contacts located inside the casing 12. Each outlet module 140~143 can respectively electrically connect to the power input portion 10 through the plurality conductive contacts disposed inside the casing 12 with any two outlet modules not having electrically linking relationship. In particular, the damage of the outlet module 140 would not have any impact on the operation of the outlet module 143. Additionally, even though that the outlet modules 140~143 shown in FIG. 1A and FIG. 1B are receptacles of three pin holes, however in practice the outlet modules 140~143 may be receptacles of two pin holes or the universal series bus (USB) port, the present disclosure therefore is not limited thereto.

Figure 1C:
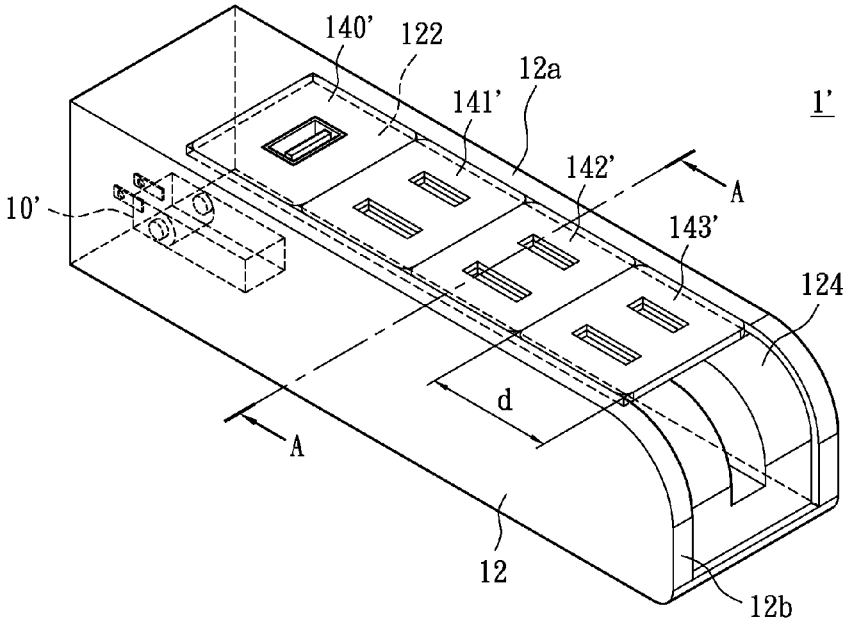
FIG. 1C is an isometric diagram illustrating an power extension cord having two-pin hole USB port provided in accordance to an exemplary embodiment of the present disclosure.

Please refer to FIG. 1C which shows an isometric diagram illustrating an power extension cord having two-pin hole USB port provided in accordance to an exemplary embodiment of the present disclosure. As shown in FIG. 1C, an outlet module 140' of a power extension cord 1' is a USB port, while the outlet modules 141'~143' are receptacles of two pin holes. Additionally, conductive blades of the power input portion 10' correspondingly design to be two-conductive blades.

Moreover, differ from previously described embodiment, the conductive blades of the power input portion 10' are directly formed on any sides of the casing instead of electrically extending to the outlet modules 140'143 through flexible wires. The conductive blades of the power input portion 10' not only may be directly formed on the casing 12 but also are retractable in the casing 12 when not connect to the city power source. Based on the above explanation, those skilled in the art shall be able to design the placement of the conductive blades according to the user needs, and the present disclosure is not limited thereto.

From an actual operation perspective, please refer back again to FIG. 1A, when the outlet modules 140~143 are tightly and sequentially arranged on the upper surface 12*a*, the accommodating portion 122 is fully occupied and the upper surface 12*a* substantially form a coplanar plane with the surfaces of the outlet modules 140~143. In other words, when the user views the upper surface 12*a* from the above, the user can see all the outlet modules 140~143 of the power extension cord 1. It can be obviously seen that without removing at least an outlet module, the outlet modules 140~143 are immovable in the accommodating portion 122 as there are no space available for the outlet modules to move. On the contrary as shown in FIG. 1B, when an outlet module (e.g., the outlet module 143) is moved to the accommodating portion 124, the accommodating portion 122 may thus have extra space for the remaining outlet modules 140~142 to move.

Taking FIG. 1A and FIG. 1B as examples, supposing each outlet module has identical size and a side with length d, since the accommodating portion 122 contains just enough space for tightly arranging exactly four outlet modules thus the length of the accommodating portion 122 can be easily deduce to be 4d. When the outlet module 143 moves to the accommodating portion 124, the total movable space (i.e., the length d1 and d2 of FIG. 1B) available for the outlet modules 140~142 is equal a side length d of a single outlet module. Please noted that FIG. 1A and FIG. 1B merely serve to illustrate the structure of the power extension cord, and hence shall not be used to limit the quantity of the outlet modules as well as the ratio relationship between the accommodating portion 122 and the outlet modules 140~143. Alternatively, each outlet module may be of different size, or the side length of each outlet module may not be equal. So that the sum of length d1 and d2 is not necessary equal to d. Based on the above explanation, those skilled in art shall be able to design the size of accommodating portion 122 as well as the quantity and dimension of the outlet modules according to the actual product or operation requirement.

(Another Exemplary Embodiment of Power Extension Cord)

Figure 1D:
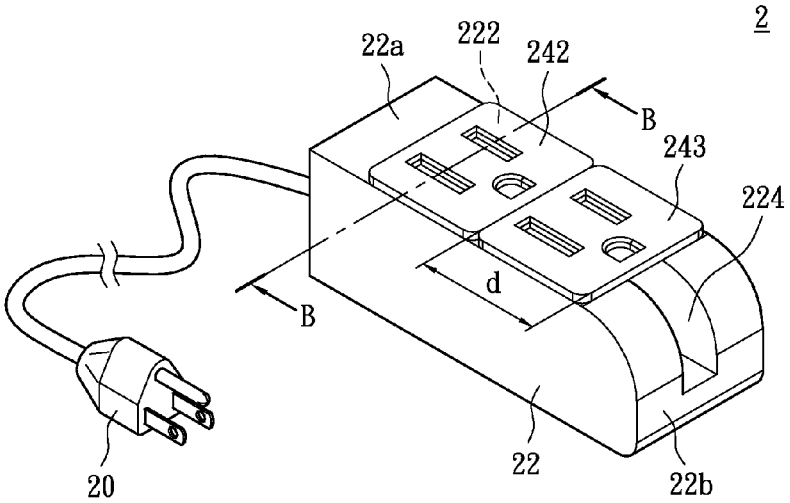
FIG. 1D is an isometric diagram of the power extension cord provided in accordance to an exemplary embodiment.

Please refer to FIG. 1D, which shows an isometric diagram of the power extension cord provided in accordance to an exemplary embodiment. As shown in FIG. 1D the power extension cord 2 of the instant embodiment includes a power input portion 20, casing 22, and two outlet modules 242~243. The power input portion 20 and the outlet modules 242~243 are essentially the same as the aforementioned embodiment, and further descriptions are thereby omitted.

The difference between the power extension cord 2 of FIG. 1D and the power extension cord 1 of FIG. 1A is in that the casing 22 of the power extension cord 2 is smaller than the casing 12 of the power extension cord 1. That is the casing 22 of the power extension cord 2 is relatively smaller in comparison to the outlet modules 240~243. In particular, the casing 22 does not enclose the outlet modules 240~243 in the accommodating portion 222 or 224. Alternatively, the outlet modules 240~243 covers the accommodating portion 222 or 224. It may be obviously noted that the instant embodiment illustrating an example showing an upper surface 22*a* of casing 22 and the surface of the outlet modules 240~243 do not form a coplanar plane. In other words, so long as a specific region of a surface on the casing 22 that can be used for arranging and disposing the outlet modules 240~243 shall fall under the scope of accommodation portion disclosed in the present disclosure. The present disclosure hereby does not limited the shape or the depth associated with the accommodating portion, and those skilled in the art shall be able to infer other appropriate accommodating designs, hence further descriptions are omitted.

(An Exemplary Embodiment of an Accommodating Portion)

Figure 2A:
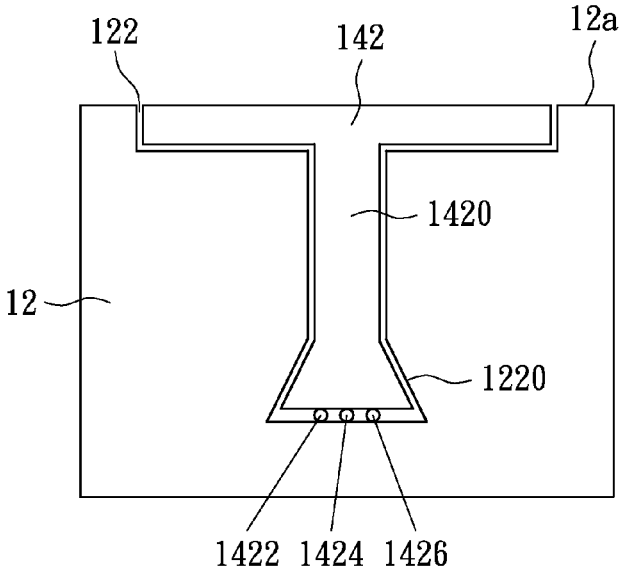
FIG. 2A is a cross section view for the power extension cord 1 alone the line A-A of FIG. 1A provided in accordance to an exemplary embodiment.

To further clarify the internal structure of the accommodating portion provided by the present disclosure. Please refer to FIG. 2A in conjunction with FIG. 1A, in which FIG. 2A shows a cross section view for the power extension cord 1 alone the line A-A of FIG. 1A provided in accordance to an exemplary embodiment. As shown in FIG. 2A, the accommodating portion 122 is used to securely holding the disposed outlet module 142. The accommodating portion 122 further includes a sliding track 1220 such that the outlet module 142 may slide along the extending direction of the sliding track 1220. The sliding track 1220 may be a recess, a sliding groove or other suitable structure disposed inside the accommodating portion 122. In addition to that the outlet module 142 can have the pin hole exposed on the surface, the outlet module 142 can further include a design of an engaging portion 1420.

Figure 3A:
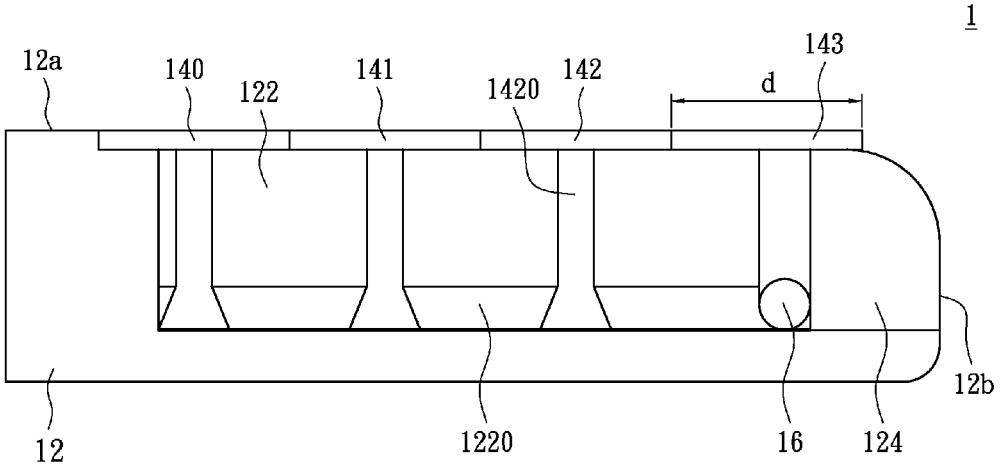
FIG. 3A is a cross section view for the power extension cord along a line C-C of FIG. 1A.

For instance, the engaging portion 1420 shown in FIG. 3A not only can securely engaging the outlet module 142 in the sliding track but also use for connection the conductive contacts 1422, 1424, and 1426 so that the electricity carried by the conductive contacts 1422, 1424, and 1426 can be delivered to the pin holes of the outlet module 142. However, the present disclosure does not place limitation as to whether or not the pin holes can only be coupled to the conductive contacts 1422, 1424, and 1426 through the engaging portion 1420 to receive electricity. For example, supposing the pin holes of the outlet module 142 takes a form of non-conductive structure, then the conductive contacts 1422, 1424, and 1426 may be installed on the conductive blade. Such that when plugging the conductive blades into the pin holes of the outlet module 142, the conductive blades can be energized achieving the same effect.

In general, the conductive contacts 1422, 1424, and 1426 are respectively used for connecting the hot wire, neutral wire, and ground wire for receiving the electricity. Specifically, the conductive contacts 1422, 1424, and 1426 may connect to the corresponding wire, conductor or conductive plates placed in the power input portion 10.

It is worth to note that the conductive contacts 1422, 1424, and 1426 are fixedly disposed in the accommodating portion 122 such that regardless which position each outlet module has slid to in the accommodating portion 122, each outlet module may electrically connect to the power input portion through the conductive contacts 1422, 1424, and 1426.

Moreover, even though the pin holes on the surface of outlet module 142 and the upper surface 12*a* are coplanar however, those skilled in the art shall be able to design in a way that the surface of the outlet module 142 is slightly lower or higher than the upper surface 12*a*. Based on the above explanation, those skilled in the art shall be able to easily infer the correspondence between the surface of outlet module 142 and the upper surface 12*a* from FIG. 2A, thus drawings of other related embodiment are omitted.

In addition, the outlet module 142 of the instant embodiment is not limited to the T-shaped structure shown in FIG. 2A. For example, the structure of the outlet module may be in a form of H-shaped with 90 degree rotation structure or a substantially C-shaped like structure. The present disclosure therefore does not limit the internal structure and actual shape of the outlet modules and those skilled in the art shall be able to design and implement the actual structure associated with the outlet modules.

Next, the configured positions of the conductive contacts 1422, 1424, and 1426 in the accommodating portion 122 are not limited by the present disclosure. For example, the conductive contacts 1422, 1424, and 1426 shown in FIG. 2A are fixedly arranged in the bottom surface of the sliding track 1220, however the conductive contacts 1422, 1424, and 1426 may also be fixedly arranged on the side surfaces of the sliding track 1220. Please refer to FIG. 2C which shows another section view of the conductive contacts provided in accordance to the FIG. 2A. As shown in FIG. 2C, the conductive contacts 1422, 1424, and 1426 are fixedly arranged on the same side surface of the sliding track however, the conductive contacts 1422, 1424, and 1426 may also be respectively arranged on two side surface (or non-coplanar), hence the present disclosure is not limited thereto.

In an actual application, the outlet modules may be able to function by electrically connecting the conductive contacts 1422 and 1424 to a hot wire and a neutral wire. Consequently, as shown in FIG. 1A by removing the conductive contact 1426 while connecting the conductive contacts 1422 and 1424 to the hot and the neutral wire, respectively, the electricity carried by the conductive contacts 1422 and 1424 may be delivered to the two pin holes of the outlet module 142. Additionally, even though the conductive contacts are disposed on the bottom surface of the sliding track, however the conductive contacts 1422 and 1424 may also be respectively arranged on the two side planar surface. Based on the above elaborations, those skilled in the art shall be able to infer the internal structure an actual shape of the outlet modules 140~143 and further descriptions are therefore omitted.

(Another Exemplary Embodiment of an Accommodating Portion)

Figure 2B:
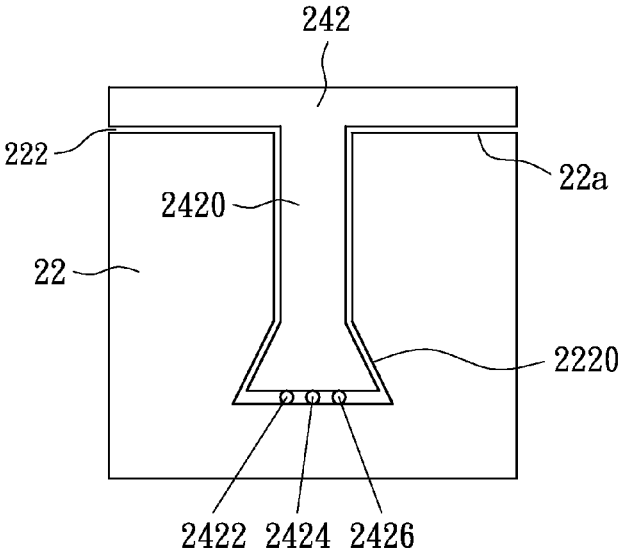
FIG. 2B is a cross sectional view for the power extension cord 1 along line B-B of FIG. 1D provided in accordance to an exemplary embodiment.
Figure 2C:
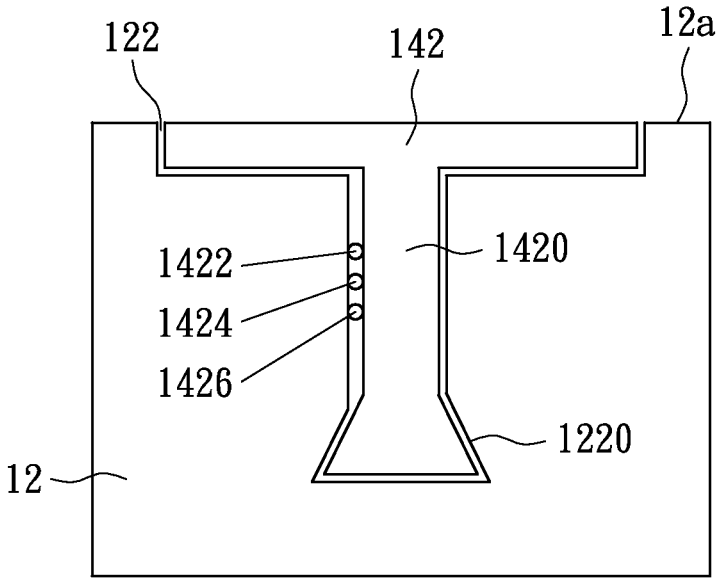
FIG. 2C is a section view of the conductive contacts provided in accordance to FIG. 2A.

Please refer to FIG. 2B in conjunction with FIG. 1D, in which FIG. 2B shows a cross sectional view for the power extension cord 1 along line B-B of FIG. 1D provided in accordance to an exemplary embodiment. As shown in FIG. 2B, the outlet module 242 is engaged on the accommodating portion 222 and the accommodating portion 222 further has a sliding track 2220 disposed therein so that the outlet module 242 may slide along the extending direction of the sliding track 2220. It can be noted from FIG. 2B, the accommodating portion 222 actually includes a partial surface 22*a* for supporting or in contact with the outlet module 242. The outlet module 242 besides having the pin hole exposed on the surface can further include a design of an engaging portion 2420. The structure and functionality of engaging portion 2420 in FIG. 2B is essentially the same as the engaging portion 1420 shown in FIG. 2A, thus further descriptions are therefore omitted.

(An Exemplary Embodiment of a Sectional Structure of a Power Extension Cord)

Please refer to FIG. 3A in conjunction with FIGS. 1A and 2A, in which FIG. 3A shows a cross section view for the power extension cord along a line C-C of FIG. 1A. As shown in FIG. 3A, the power extension cord 1 may be divided into slidable outlet modules 140~142 and a rotatable outlet module 143. The movable outlet modules 140~142 are positioned on the sliding track 1220 while the rotatable outlet module 143 is connected to a shaft 16.

Figure 3B:
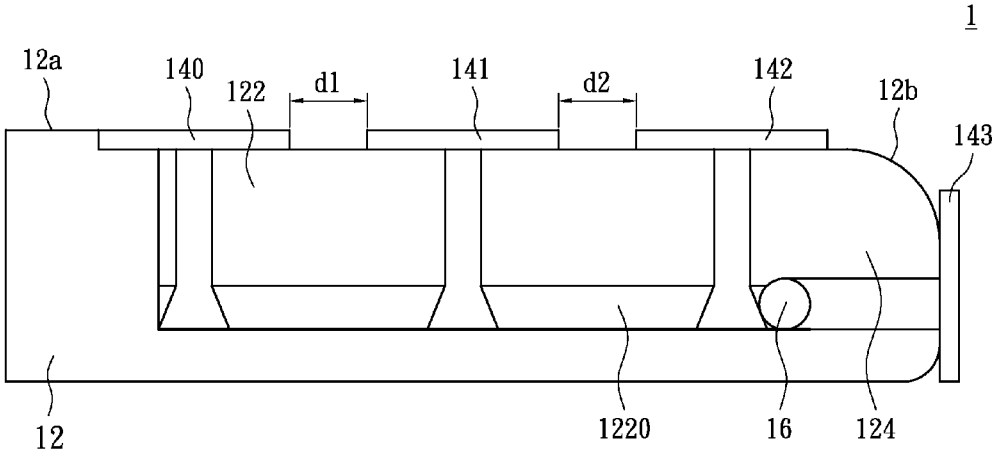
FIG. 3B is a cross section view for the power extension cord along a line C-C of FIG. 1B.
Figure 3C:
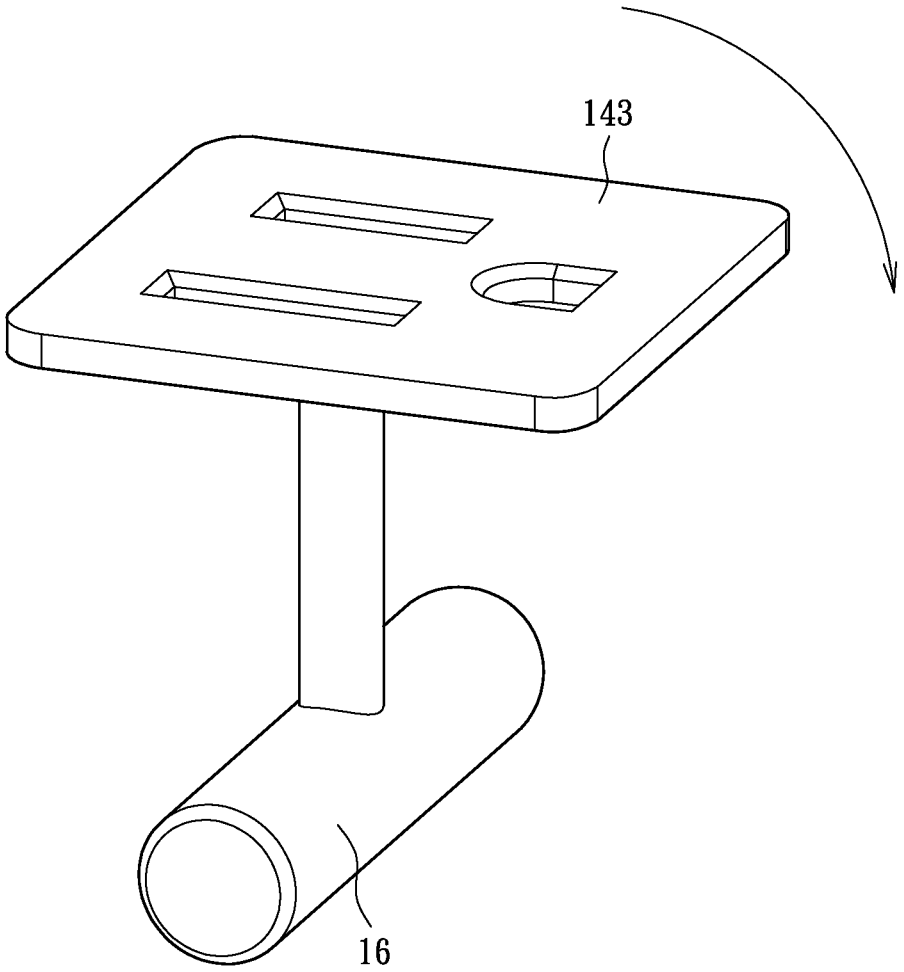
FIG. 3C is a structural diagram of a shaft in accordance to FIG. 3A.

Please refer to FIG. 3C, which shows a structural diagram of a shaft in accordance to FIG. 3A. As shown in FIG. 3C, the extending direction of the shaft 16 is perpendicular to the extending direction of the sliding track 1220. Regardless the outlet modules 140~142 or the outlet module 143 shall have electrical relationship with the power input portion 10. Alternatively, the outlet modules 140~142 slides along the sliding track 120 while the outlet module 143 rotates around the shaft 16. In another implementation, the outlet module 143 may be mounted on a fixed pivot point using riveting or pivoting connection to achieve the described rotation feature, however the present disclosure is not limited thereto.

In practice, the outlet module 143 may be in a form of a non-conductive structure or a conductive structure having electrical energy formed therein. When the outlet module 143 takes form of a non-conductive structure, either can have the conductive blades of the plug plugging into the outlet module 143 to be in contact with the conductive structures of conductive contacts 1422, 1424, and 1426 disposed on the sidewall or the bottom surface of the outlet module 143 or directly have the conductive blades of the plug electrically connect to the conductive contacts 1422, 1424, and 1426, but the present disclosure is not limited herein.

As shown in FIG. 3A, since the outlet module 143 has not yet rotated to the side surface 12*b*, the outlet modules 140, 141, and 142 are therefore immovable as being held in the accommodating portion 144 (e.g., the casing 12 may be held in against to the outlet module 140 or the outlet module 140 may be held by one end of the sliding track 1220. Next, please refer to FIG. 3B in conjunction with FIG. 1B, FIG. 3B shows a cross section view for the power extension cord along a line C-C of FIG. 1B. When the outlet 143 rotates to the side surface 12*b*, forming an extra space of length d for the outlet modules 140, 141, 143 to move such that the spacing among the outlet modules may be adjusted (e.g., the spacing d1 between the outlet modules 140, 141 and the spacing d2 between the outlet modules 141, 142), for which the sum of length d1 and d2 is equal to the length d originally occupied by the outlet module 143 on the surface 12*a* of FIG. 3A.

Additionally, although the FIG. 3A and FIG. 3B merely illustrates the outlet module 143 connecting to the shaft 16, however the present disclosure is not limited thereto. For instance, the first or the last outlet modules disposed in the accommodating portion 122 may be designed to be movable outlet module allowing the movable outlet modules to have larger moving space. It is worth to noted that as shown in FIG. 3A the outlet modules 140~142 appears to have form of a T shape, but the outlet modules 140~142 can further designed to take the form of an upside down L, thus the present disclosure is not limited.

(Another Exemplary Embodiment of a Sectional Structure of a Power Extension Cord)

Figure 4A:
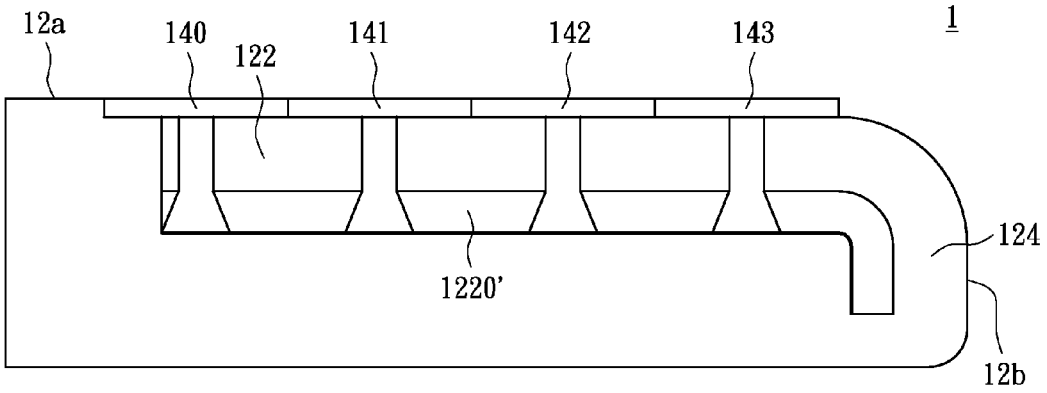
FIG. 4A is a cross section view for the power extension cord along a line C-C of FIG. 1A.

Different from the design of the shaft 16 provided in FIG. 3A, the instant embodiment further discloses an accommodating portion having connected sliding track. Please refer to FIG. 4A in conjunction with FIG. 1A, in which FIG. 4A shows a cross section view for the power extension cord along a line C-C of FIG. 1A. As shown in FIG. 4A, the power extension cord 1 in the instant embodiment can have an interconnected sliding track 1220' and the interconnected sliding track 1220' may penetrate the accommodating portions 122 and 124. Different from the aforementioned embodiment, in the instant embodiment not only that the endmost outlet module 143 can rotate to the accommodating portion 124 located on the upper surface 12*a*, but also that each outlet module may slide into the accommodating portion 124 so long as the accommodating portion 124 has sufficient enough space.

Figure 4B:
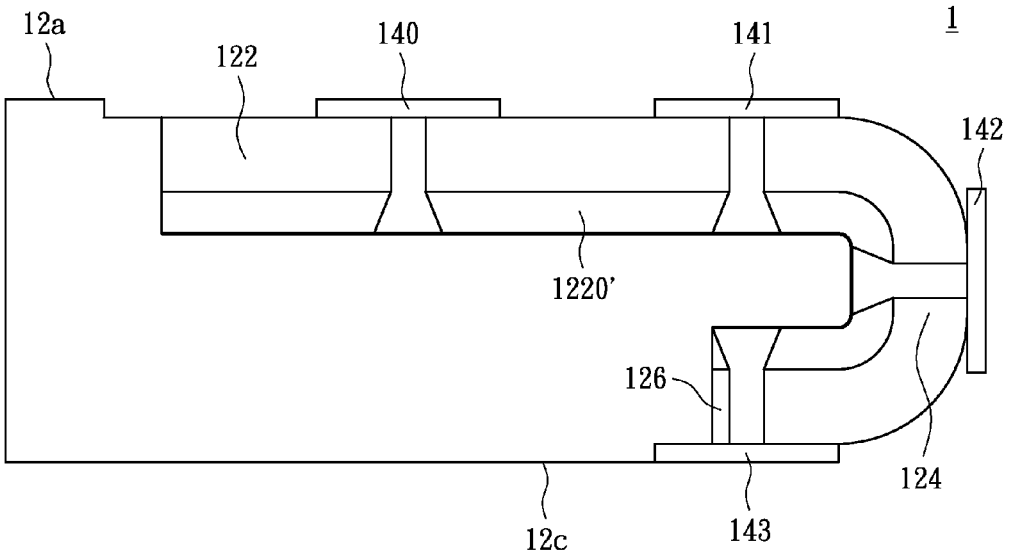
FIG. 4B is a cross section view for the power extension cord along a line C-C of FIG. 1B.

In practice, the sliding track may continue extend down to the bottom surface 12*c* of casing 12. Please refer to FIG. 4B, which shows a cross section view for the power extension cord along a line C-C of FIG. 1B. The bottom surface 12*c* of the casing 12 may herein has an accommodating portion 126, so that the outlet module arranged in the accommodating portion 122 may move to the accommodating portion 126 through the accommodating portion 124. Henceforth the power extension cord shown in FIG. 4B may allow the plug holes to be utilized on multiple surfaces through properly positioning the outlet module on the power extension cord thereby increase the usage convenience. It is worth to note that the adjustable spacing among the movable outlet modules are related to the actual size of accommodating portions 124 and 126. That is the larger the size of the accommodating portions 124 and 124, the larger the adjustable spacing between any two of the outlet modules 140~143.

(Another Exemplary Embodiment of a Sectional Structure of a Power Extension Cord)

Figure 5:
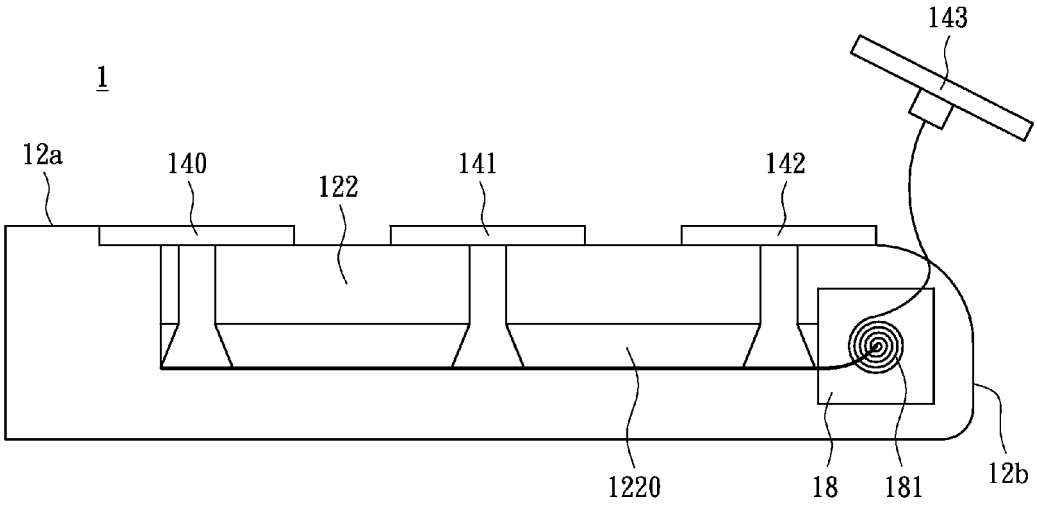
FIG. 5 is a cross section diagram illustrating a power extension cord in an operation.

Different from the design of the shaft 16 shown in FIG. 3A and sliding track 1220' shown in FIG. 4A, the instant embodiment discloses a power extension cord in which the outlet module can be pulled out of casing. Please refer to FIG. 5, which shows a cross section diagram illustrating a power extension cord in an operation. As shown in FIG. 5, the power extension cord 1 has the slidable outlet modules 140~142 and a pullable outlet module 143. The slidable outlet modules 140~142 are locked on the sliding track 1220 with one end of the sliding track 1220 having at least a wire retractor 18 installed. The wire retractor 18 is used for retracting the extension cord 181 wherein the extension cord 181 respectively electrically connects to the power input portion 10 and the outlet module 143. In general, the power extension cord 181 are formed of a hot wire, a neutral wire and a ground wire wrapping and covering by a plastic protection layer. However, in practice the ground wire can be selectively removed depend upon actual usage requirement of the outlet modules. Accordingly, the pin holes of the outlet module 143 may thus correspondingly design to be a two-pin hole.

When the user pulls the outlet module out of the casing of the power extension cord 1, the wire retractor 18 corresponding releases the extension cord to have the outlet module 143 moved out of the accommodating portion 122. So that the outlet modules 140~142 can now have space to move within the accommodating portion 122 with the spacing between outlet modules can adjusted by the user.

It is worth to note that even though the user has pulled the outlet module 143 out of the casing of the power extension cord 1, however, the outlet module 143 can still connect to the power input portion 10 to prevent the user lost the outlet module 143 during the removing operation. Moreover, the user may dispose the outlet module 143 being pulled out of the accommodating portion 122 into other accommodation portions or other appropriate places according to the operation conditions and the instant embodiment is not limited herein. Additionally, the outlet module 143 may also be movably disposed in the accommodation portion 122 via extension cord 181. In other words, although the outlet module 143 has been moved out of the initial position, but the outlet module 143 and outlet modules 140~142 are still on the same plane such that the outlet modules 140~142 may uses the sliding space left by the outlet module 143.

In practice, the extension cord 181 may have flexibility (e.g., flexible cable) and the wire retractor 18 can have wire retracting or reeling structure (e.g., the wire may be retracted by pressing a retracting button). For instance, the wire retractor 18 may be realized by installing a locking structure such as a ratchet. In one operation of using the locking mechanism may be pulling out a predetermined length cord of the extension cord 181 through the wire retractor 18 to have the locking structure locked cord being pulled out as well as have the locking structure release the pulled portion of extension cord for allowing the extension cord 181 reeling back to the wire retractor 18. It shall be noted that the wire reeling or winding operation of the wire retractor 18 may be manual winding or auto retracting depend upon the implementation of the locking structure and the present disclosure does not limited thereto.

(An Exemplary Embodiment of a Power Extension Cord)

Figure 6:
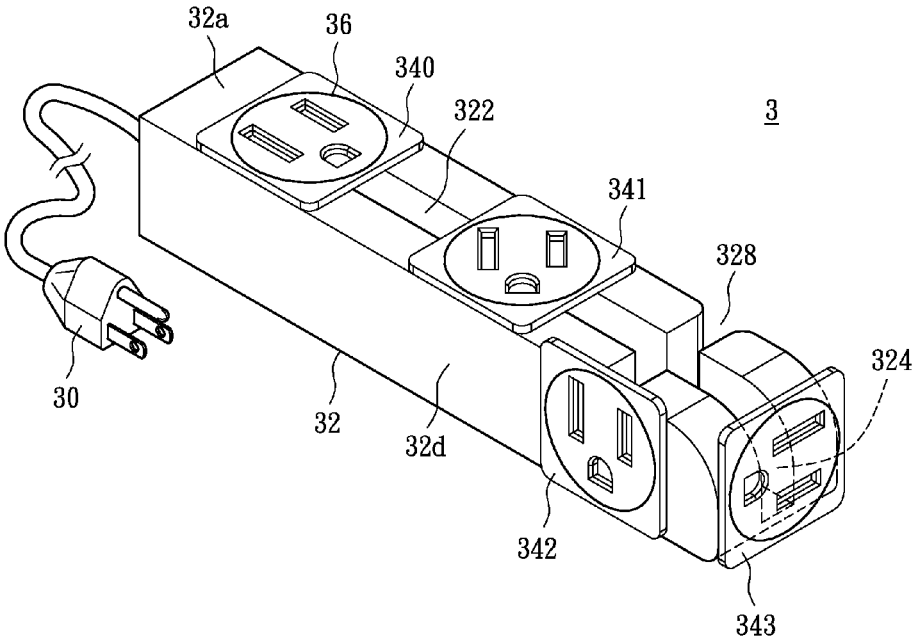
FIG. 6 is an isometric diagram illustrating the power extension cord in operation provided in accordance to an exemplary embodiment.

For effectively utilized each and every outlet module, please refer to FIG. 6, which shows an isometric diagram illustrating the power extension cord in operation provided in accordance to an exemplary embodiment. The power extension cord 3 as shown in FIG. 6 includes the input power portion 30, casing 32 and a plurality of outlet modules 340~343. When not in use the outlet modules 340~343 may be tightly and sequentially arranged in an accommodating portion 322 on an upper surface 32*a* of casing 32.

Different from the aforementioned embodiment, an accommodating portion 328 having opening arranged on at least a side surface 32*d* of the casing 32. The accommodating portions 322 and 328 are interconnected. Additionally, the accommodating portion 328 also have a sliding track (no shown in FIG. 6) disposed thereon. Thus after the outlet module 343 slides to the accommodating portion 324, the next outlet model not only may slide in the accommodating portion 322 but also may selectively move to the accommodating portion 328 such that a larger sliding or moving space for outlet modules 340, 341 can be provided.

Each of the outlet modules 340~343 further has a rotatable rotating plate 36 for configuring the orientation associated with the pin holes of the outlet modules 340~343. For example the outlet modules 341~343 of FIG. 6 may configure the orientation of the pin hole through the respect rotating plate 36. Accordingly, the power extension cord may enable power adapter or power plug with different size plug-in to each outlet module thereby maximizing the receptacle utilization.

It is worth to note that the instant embodiment does not limit the position associated with the opening of the accommodating portion 328 on the side surface 32*d*. For instance, the opening position of the accommodating portion 328 corresponds to the location of the outlet module 343 on the upper surface 324, however the opening of the accommodating portion 328 may corresponds to location of any outlet modules 340~342 on the upper surface 32*a*.

(Another Exemplary Embodiment of a Power Extension Cord)

Figure 7:
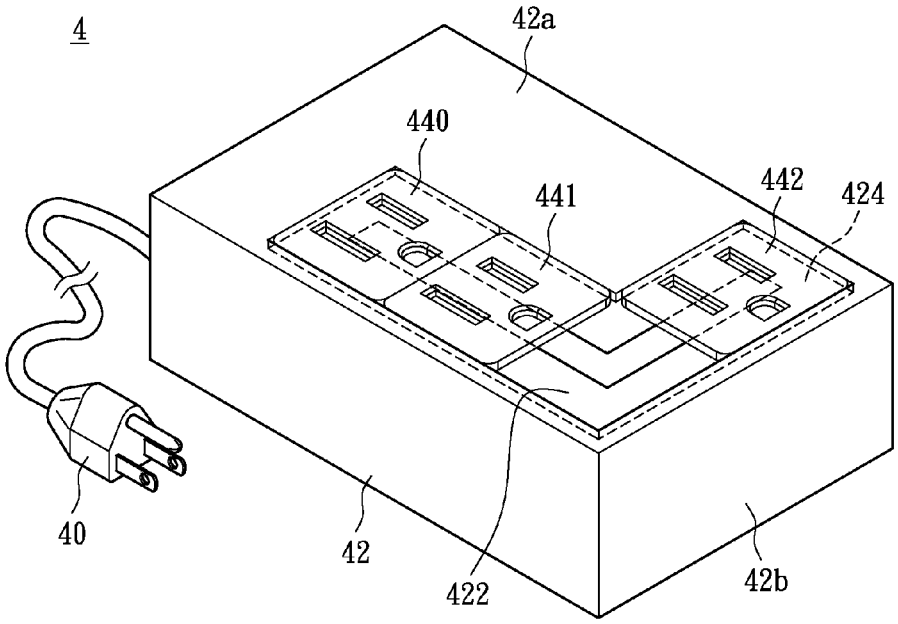
FIG. 7 is an isometric diagram illustrating a power extension cord in operation provided in accordance to an exemplary embodiment of the present disclosure.

Please refer to FIG. 7, which shows an isometric diagram illustrating a power extension cord in operation provided in accordance to an exemplary embodiment of the present disclosure. As shown in FIG. 7, the power extension cord 4 includes a power input portion 40, a casing 12, and a plurality of outlet modules 440~442. Different from the aforementioned embodiment, the accommodating portions 422 and 424 disposed on the casing 42 have the openings respectively positioned on an upper surface 42*a* of casing 42 while a side surface 42*b* is designed as a flat surface.

The accommodating portions 422 and 424 are interconnected so that when viewing from the upper surface 42*a* of the power extension cord 4, the interconnected space formed from the accommodating portions 422 and 424 appearing to be an L shape space. Additionally, the accommodating portions 422 and 424 have sliding tracks (not shown in FIG. 7) disposed therein. When not in use the outlet modules 440~442 may be tightly and sequentially arranged in an accommodating portion 422 on the upper surface 42*a* of casing 42. After the outlet module 442 moves to the accommodating portion 424, the outlet modules 440 and 441 may become slidable in the accommodating portion 422.

In summary, the power extension cord provided by an exemplary embodiment of the present disclosure may through move out at least an outlet module from the initial accommodating portion enabling the remaining outlet modules positioned on the sliding track to move freely. The available moving space of the remaining outlet modules is equal to the original space occupied by the outlet module being removed. Accordingly, the power extension cord only have the outlet modules sliding in a fixed casing thus does not need either the pulling structure or any modifications to the casing structure. Henceforth, the power extension cord provided by the present disclosure not only can greatly increase the durability but also can resolve the issue of having the nearby outlet being covered by power adapter with larger size using simple structure thereby lowered the manufacture cost.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. A power extension cord with movable outlets, comprising:

a casing, at least having a first accommodating portion, the first accommodating portion having at least a first sliding track and a conductive contact;

a power input portion, electrically connected to the conductive contact; and a plurality of outlet modules, each outlet module has at least a pin hole, when a conductive blade of a plug is engaged into the corresponding pin hole, the conductive blade of the plug electrically connects to the conductive contact, and at least an outlet module being movably disposed on the first sliding track;

wherein when all the outlet modules are arranged on the first accommodating portion, at least an outlet module is immovably arranged on the first sliding track; when at least an outlet module is dislocated in the first accommodating portion, at least an outlet modules disposed on the first sliding track becomes movable, wherein a length of the first sliding track is longer than a sum of lengths of the outlet modules;

wherein the outlet modules comprise a plurality of movable outlet modules, at least a pullable outlet module and at least a rotatable outlet module, the movable outlet modules being movably disposed on the first sliding track, and the rotatable outlet module is connected to a first shaft, the first shaft extending toward the direction being perpendicular to the extending direction of the first sliding track.

2. The power extension cord with movable outlets according to claim 1, wherein when at least an outlet module is not positioned in the first accommodating portion, the movable space of the outlet modules arranged on the first sliding track is equal to the initial space occupied by the removed outlet module.

3. The power extension cord with movable outlets according to claim 1, wherein the casing further comprises a second accommodating portion, when the rotatable outlet module moves from the first accommodating portion to the second accommodating portion, the pin hole of the rotatable outlet module exposed on a first surface of the casing while the pin hole of the movable outlet module exposed on a second surface of the casing, wherein the first surface and the second surface are non-coplanar.

4. The power extension cord with movable outlets according to claim 1, wherein when the outlet modules all positioned on the first accommodating portion, the outlet modules are sequentially disposed on the first accommodating portion with the first outlet module or the last outlet module among the outlet modules being the rotatable outlet module or the pullable outlet module.

5. The power extension cord with movable outlets according to claim 1, wherein the casing further comprises a second accommodating portion, the second accommodating portion at least having a second sliding track disposed therein, the first accommodating portion and the second accommodating portion being interconnected while the first sliding track being connected to the second sliding track so as to have the outlet modules selectively sliding between the first sliding track and the second sliding track.

6. The power extension cord with movable outlets according to claim 5, wherein when at least an outlet module moves from the first accommodating portion to the second accommodating portion, the pin hole of the outlet modules in the first accommodating portion exposed on a first surface of the casing while the pin hole of the outlet module in the second accommodating portion exposed on a second surface of the casing, wherein the first surface and the second surface are non-coplanar.

7. The power extension cord with movable outlets according to claim 1, wherein the pin hole of at least an outlet module is a universal serial bus port.

8. The power extension cord with movable outlets according to claim 1, wherein the pin hole of the outlet modules are two-pin holes or three-pin holes.

* * * * *